United States Patent [19]

Hollingsworth et al.

[11] 3,982,354

[45] Sept. 28, 1976

[54] WALKING DOLL MECHANISM

[75] Inventors: Charles M. Hollingsworth, West Columbia; Witold W. Kosicki, Columbia, both of S.C.

[73] Assignee: Horsman Dolls Inc., Columbia, S.C.

[22] Filed: Sept. 11, 1975

[21] Appl. No.: 612,238

[52] U.S. Cl. ..... 46/149
[51] Int. Cl.[2] ..... A63H 11/14
[58] Field of Search ..... 46/149, 150

[56] References Cited

UNITED STATES PATENTS

| | | | |
|---|---|---|---|
| 2,996,837 | 8/1961 | Beebe | 46/149 |
| 3,050,903 | 8/1962 | Kaplan | 46/149 |
| 3,228,143 | 1/1966 | Kaplan | 46/149 |

*Primary Examiner*—F. Barry Shay
*Attorney, Agent, or Firm*—Shenier & O'Connor

[57] ABSTRACT

A walking simulating apparatus for a doll having legs pivotally mounted on the doll's torso for movement around respective axes extending at an acute angle to the vertical axis of the torso in which a pair of oppositely laterally extending arms carried by a pivot extending in the general direction of the torso vertical axis and resiliently urged into engagement with frustoconical interior surfaces formed on the leg flange inserts carry detents adapted to engage first recesses in the leg flange insert surfaces to provide a releasable driving connection between the legs between limit positions determined by a third arm mounted for movement with the driving arms and extending generally perpendicularly thereto between the leg flanges so as to engage the flange inserts respectively at the limit positions corresponding to the limits of a stride of the doll. In response to a twisting force on a leg exceeding that with which the detent is held in the recess each leg can be moved to position corresponding to a sitting position of the doll in which position the detents ride into a second position in which the legs are releasably held.

14 Claims, 6 Drawing Figures

Fig 1
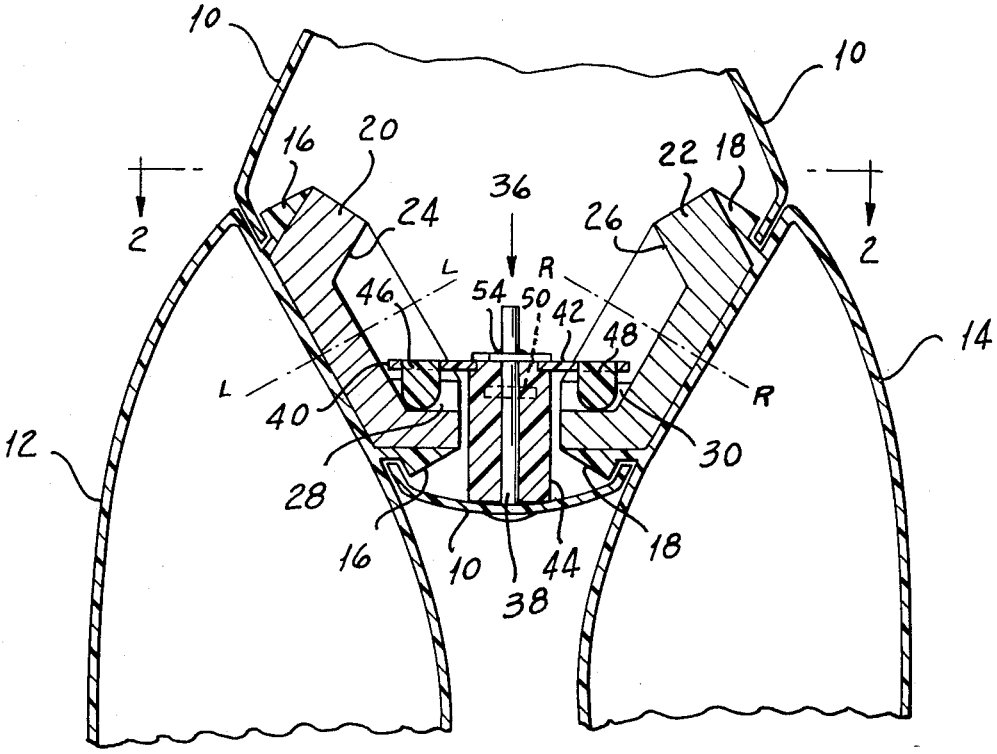
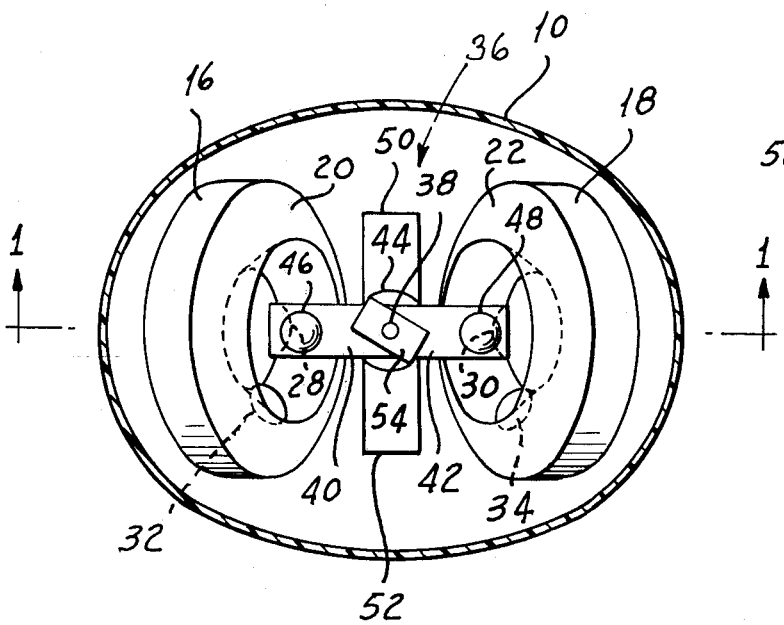
Fig 2
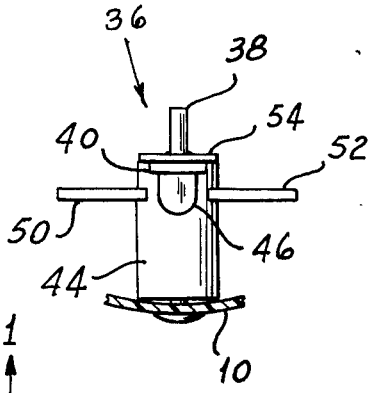
Fig 3

Fig 4
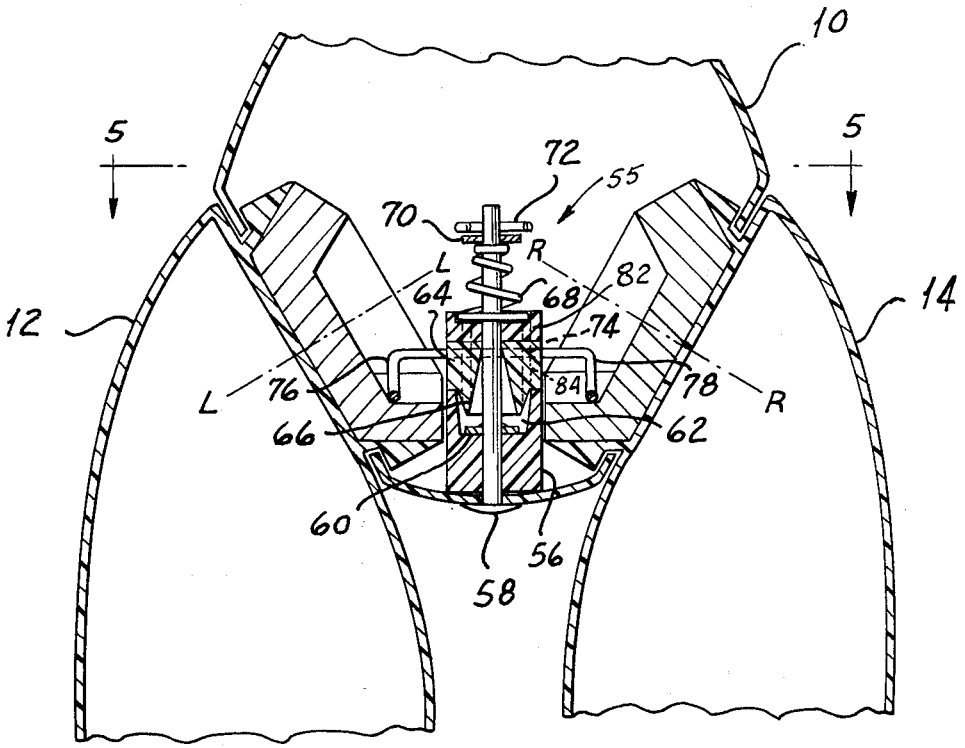
Fig 5
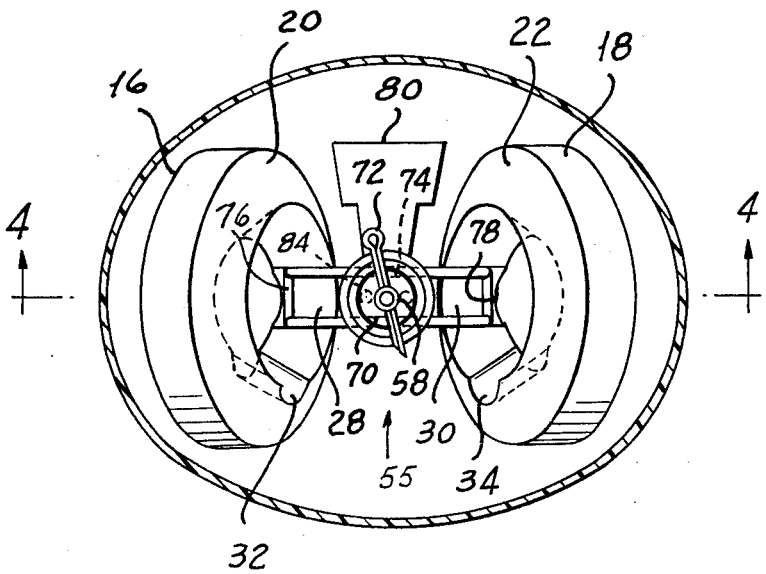
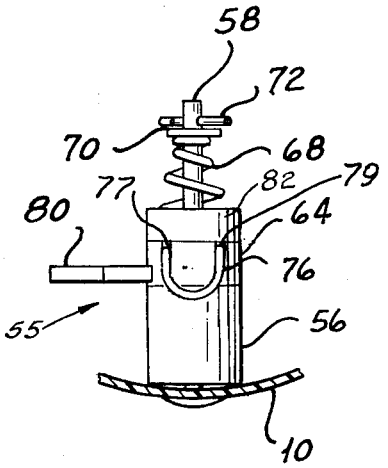
Fig 6

WALKING DOLL MECHANISM

BACKGROUND OF THE INVENTION

This invention relates to an improved walking mechanism for use in a children's doll.

There are a number of prior art mechanisms for simulating walking movement of a doll's legs. Generally these mechanisms employ a reciprocating arm mounted on a vertical axis and adapted to engage the flange portions of a doll's leg. Such mechanisms suffer several disadvantages. Most of these mechanisms have notches, stops or the like on the leg flanges which permit only a limited amount of backward movement of the leg. The mechanism may easily be broken by attempting to move a leg backward past its normal walking swing. Also, while these mechanisms generally restrict the forward movement of the legs past a normal sitting position, no means is provided for locking the legs into such a sitting position. Furthermore, mechanisms have generally been developed which arrange such an arm to engage the flanges either from above or from behind, thus making the arrangement large physically or complicated mechanically. Adding to the complexity of existing mechanisms is the necessity for providing separate limit stops for cooperation with the limit arms used to limit the back-and-forth walking motion of the legs. Many walking simulating mechanisms of the prior art require relatively close tolerances and are difficult to assemble.

SUMMARY OF THE INVENTION

One object of our invention is to provide a walking simulating mechanism for a doll which overcomes the defects of walking simulating mechanisms of the prior art.

A second object of our invention is to provide a walking mechanism for a doll which permits the legs to be rotated in either direction without breaking.

A third object of our invention is to provide a walking mechanism for a doll which allows the legs to be releasably locked in a sitting position.

A fourth object of our invention is to provide a walking mechanism for a doll which is simple and compact.

A fifth object of our invention is to provide a walking mechanism for a doll which does not require close tolerances in the manufacture thereof.

A sixth object of our invention is to provide a walking mechanism for a doll which is easy to assemble.

Other and further objects of our invention will appear from the following description.

In general our invention contemplates a walking mechanism for use in a children's doll which simulates walking movement of the legs and which provides detents for standing and sitting leg positions. Oppositely extending arms rotatably mounted on a vertical support on the torso carry detents which are urged into engagement with first recesses located on the sides of frusto-conical flange wells located in the center of the flanges retaining the legs on the torso to provide a releasable driving connection between the legs. One or more limit arms, extending from the rocker arm and adapted to abut a leg flange when the rocker arm is rotated sufficiently far, limit the length of the stride. The legs may be placed in a sitting position by applying sufficient torque around their pivot axis, causing the arm detents to disengage from the first recesses and to engage second recesses angularly displaced from the first recesses in the flange releasably to hold the legs in the sitting position.

The flange well recesses are preferably formed of semi-cylindrical channels disposed radially along the sides of the flange wells, although hemispherical recesses function almost as well. The arms, which may be urged into engagement with the flange well recesses either by their own resilience or by external means, preferably engage the recesses by means of rounded boss detents. Both the recesses and the detents or other engaging means are shaped such that they will disengage simply by twisting the leg sufficiently hard in either direction.

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a vertical section of one embodiment of our walking mechanism, taken along line 1—1 of FIG. 2.

FIG. 2 is a horizontal section of the embodiment shown in FIG. 1, taken along line 2—2 of FIG. 1.

FIG. 3 is a side elevation, shown partly in section, of the coupling and limit arm assembly of the embodiment shown in FIG. 1.

FIG. 4 is a vertical section of an alternative embodiment of our walking mechanism, taken along line 4—4 of FIG. 5.

FIG. 5 is a horizontal section of the embodiment shown in FIG. 4, taken along line 5—5 of FIG. 4.

FIG. 6 is a side elevation, shown partly in section, of the coupling and limit arm assembly of the embodiment shown in FIG. 4.

DESCRIPTION OF THE PREFERRED EMBODIMENT

Referring to FIGS. 1 to 3, we show an embodiment of our walking doll mechanism employing a springless coupling and limit arm assembly. In this embodiment, the torso 10 of the doll is pivotally connected to left and right legs 12 and 14 by means of leg retainer flanges 16 and 18 within the torso, respectively, permitting rotation of the legs 12 and 14 on respective axes L—L and R—R. Seated within the leg flanges 16 and 18 are respective flange inserts 20 and 22, which are provided with frusto-conical wells having sides 24 and 26 which are sloped at such an angle that at their lowest point the sides are substantially tangent to the horizontal plane when the doll is erect. While the flanges 16 and 18 and the flange inserts 20 and 22 are shown here as separate elements, the respective flanges and flange inserts may also be molded out of single pieces of rubber or plastic material. The sides 24 and 26 are provided with a first pair of recesses 28 and 30, located such that they are innermost or nearest the doll's center line when the legs are in a standing position and with a second pair of recesses 32 and 34 are located on the sides such that they are innermost when the legs in a sitting position. The first pair of recesses 28 and 30 comprise hemicylindrical channels disposed radially on sides 24 and 26, while the second pair of recesses 32 and 34 are simply hemispherical depressions provided in the sides 24 and 26.

Located between the flanges 16 and 18 is a coupling and limit arm assembly, indicated generally by the reference numeral 36, used to simulate walking action and releasably to retain the legs in sitting and standing positions. The coupling and limit arm assembly 36, includes a pair of resilient arms 40 and 42 extending oppositely from a spacer 44 carried by a rotatable pivot pin 38 extending generally in the direction of the longitudinal axis of torso 10. We equip the arms 40 and 42 with detents or bosses 46 and 48 which, when the doll is in the standing position as shown, engage the recesses 28 and 30 in the sides 24 and 26. A second pair of arms 50 and 52 extend from the base 44 below the first pair of arms 40 and 42 and at right angles thereto. These latter arms abut the flange hubs 20 and 22 when rotated sufficiently far, thus providing stops which determine the limits of the stride of the doll. A pushnut 54 on the pin 38 secures the entire assembly against the wall of the torso 10.

In the normal or standing position, the bosses 46 and 48 rest in the recesses 28 and 30, respectively. When the doll is walked by moving, say, its left leg 12 to simulate a walking movement, the resulting rotation of the flange 16 will cause the arms 40 and 42 to the pivot around the pin 38, thereby rotating the other flange 18 by virtue of the engagement of detents 46 and 48 in recesses 28 and 30, and hence the right leg 14 in the opposite direction, simulating a walking movement. The recesses 28 and 30 are preferably channel shaped rather than round in order to permit radial play to the arms 40 and 42 when they are pivoted. The stop provided by the arms 50 and 52 as they abut the flange hubs 20 and 22 limits the extent of the stride both forward and backward of the aligned position of the legs 12 and 14.

By applying sufficient twisting force around the axis L—L or R—R, either of the legs 12 or 14 may independently be moved past its walking excursion limit. Such twisting force, when applied to flange 16 or 18 through its associated leg, will disengage the recess 28 or 30 from the boss 46 or 48, which is prevented from following the hub past the excursion limit by arm 50 or 52. The leg 12 or 14 may now be freely pivoted around the axis L—L or R—R. When the leg is brought forward into a sitting position, the boss 46 or 48 engages the second recess 32 or 34 in the hub 20 or 22, locking the leg into a sitting position. By applying sufficient torque around the axis L—L or R—R, the leg may be disengaged from this position in the manner described above.

Referring now to FIGS. 4 to 6, we show an embodiment of our walking doll mechanism employing an alternative coupling and limit arm assembly. Also in this embodiment, both pairs of rim recesses are channel-shaped rather than only the normally-engaged recesses 28 and 30. In this assembly, indicated generally by the reference numeral 55, a base 56 is located by a pin 58 extending upward from the wall of the torso 10 and generally in the direction of the longitudinal centerline thereof. A pushnut 60 seated at the bottom of a well 62 formed in the top of the base 56 secures the pin 58, the base 56 and the torso 10 in assembled relationship. We mount a swivel rocker element 64 on pin 58 above the base 56 with a rounded boss 66 at the lower end thereof extending into well 62 and with a shoulder around boss 62 resting on the upper edge of base 56 around well 62. The bore of the rocker element 64 is flared outwardly from top to bottom and the boss 66 is rounded to permit the rocket member 64 to rock back and forth, within limits, in the base well 62 in a manner to be described.

The coupling arms of the form of our invention shown in FIGS. 4 to 6 are formed from a loop member 74 comprising a length of wire which is first bent to the shape of a generally rectangular loop with the ends of the length bent downwardly at a location intermediate the ends of one of the loop legs. Next, the ends of the loops are bent downwardly to form the camming detents 76 and 78 for cooperation with the pairs of recesses in the flange inserts. After the coupling arms have thus been formed the legs of the loop are inserted in spaced grooves 77 and 79 in the upper surface of element 64 with the downturned ends of the length positioned in a bore in the bottom of one of the grooves. A retainer cap 82 is assembled on pin 58 and is secured to member 64 by screws 84 or the like to hold the member 74 in the grooves. Finally a compression spring 68 and a washer 70 are assembled on the upper end of pin 58 with the lower end of the spring in a recess in the top of the cap 82. A cotter pin 72 inserted through a bore in pin 58 retains washer 70 and spring 68 in compressed condition on the pin 58. It will be appreciated that the wire loop 74 forms relatively rigid arms as compared with the resilient arms of the form of our mechanism shown in FIGS. 1 to 3. A limit arm 80, extending from the rocker member 64 below and at a right angle to the loop member 74, abuts flange insert 20 and 22 when the rocker member rotates sufficiently far, providing a stop.

The operation of this alternative embodiment is much the same as that of the first. In a normal or standing position, the loop ends 76 and 78 engage rim recesses 28 and 30 respectively. Rotation of a flange in response to the walking of that leg causes the loop member 74 to pivot around the pin 56 and thus the other flange to counter-rotate, providing the desired walking action. The length of the stride this provided is limited by the limit arm 80, which functions essentially the same as limit arms 50 or 52 of the first embodiment. Disengagement of either of the legs 12 or 14 is accomplished by continuing to twist the leg after the stop is reached, causing the loop end 76 or 78 to disengage from the normal recess 28 or 30 and allowing the leg to be freely rotated. The doll's legs are locked into a sitting position by bringing them sufficiently forward to allow the loop ends 76 and 78 to engage the sitting position recesses 32 and 34. In the form of our invention illustrated in FIGS. 1 to 3 the inherent resilience of arms 40 and 42 permits the coupling between the arms and the legs to be released. In the form of our invention illustrated in FIGS. 4 to 6, tilting of the legs together with member 64 against the action of spring 68 permits the coupling between the loop 74 and the legs to be released upon twisting of the legs.

It will be seen that we have accomplished the objects of our invention. We have provided a walking simulating mechanism for a doll which overcomes the defects of mechanisms of the prior art intended to achieve the same purpose. Out mechanism permits the legs of the doll to be rotated in both directions through any angular extent without damage to the operating parts of the mechanism. Owing to the fact that the operating mechanism is located generally at the longitudinal axis of the torso it is simpler and more compact than are mechanisms of the prior art. It does not require close tolerances in the manufacture thereof.

It will be understood that certain features and subcombinations are of utility and may be employed without reference to other features and subcombinations.

This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Walking simulating apparatus for a doll including in combination, a torso having a longitudinal axis, a pair of leg mounting openings in said torso, a pair of legs, means mounting said legs respectively in said mounting openings, for movement around respective axes, each of said mounting means forming a surface extending around the axis of rotation of its associated leg, a recess in each of said surfaces, a pair of arms, respective detent means on said arms, and means mounting said arms for pivotal movement around an axis extending between said leg mounting means and with said detent means in cooperative relationship with said surfaces, said arm mounting means comprising means for resiliently urging said detent means into engagement with said surfaces so that when said detents engage in said recesses said arms provide a releasable driving connection between said legs to simulate a walking movement of said doll, each of said surfaces for an appreciable extent from said recess in each direction around the associated said axis being symmetrical with respect to said associated axis to permit said driving connection to be released against the action of said resilient means in each direction of relative movement of said detent means with respect to the associated surfaces without damage to the apparatus.

2. Apparatus as in claim 1 including means for limiting the movement of said legs under the action of said driving connection.

3. Apparatus as in claim 2 in which said limiting means comprises a limit arm carried by said arm mounting means for movement therewith.

4. Apparatus as in claim 1 in which the axis of pivotal movement of said arms extends generally in the direction of said longitudinal centerline of said torso.

5. Apparatus as in claim 1 in which said means urging said detent means comprises inherently resilient portions of said arms.

6. Apparatus as in claim 1 in which said arm mounting means comprises means mounting said arms for pivotal movement around said arm axis and for rocking movement with relation thereto and in which said arm urging means comprises a spring for urging said arms in the direction of said arm axis.

7. Apparatus as in claim 1 in which each of said leg mounting means comprises a retaining flange disposed within said torso and in which said surface forming means forms an interior surface on said flange.

8. Apparatus as in claim 7 in which each of said surfaces is a frusto-conical surface.

9. Apparatus as in claim 1 in which each said surfaces includes a second recess spaced from said first recess, said second recesses adapted to receive said detent means in a sitting position of said legs.

10. Apparatus as in claim 1 including stop means for limiting the movement of said legs in each direction under the action of said coupling, and in which each of said surfaces includes a second recess spaced beyond the limit of movement of said leg in one direction of movement of the leg, each leg adapted to be moved out of the associated first-named recess against the action of said urging means with said stop means limiting the movement of the leg and into the associated second recess, said second recesses corresponding to sitting position of said legs.

11. Walking simulating apparatus for a doll including in combination, a torso having a longitudinal axis, a pair of leg openings in said torso, a pair of legs, means including retainer flanges disposed within said torso for mounting said legs in said leg mounting openings for movement around respective axes, each of said flanges being formed with frusto-conical interior surfaces generally symmetrical with said leg axes, a pair of oppositely extending coupling arms, means mounting said arms on said torso for pivotal movement around an axis extending generally in the direction of said longitudinal axis of said torso and with the ends thereof overlying said surfaces, respective first recesses in said surfaces, detents secured to the ends of said arms adapted to engage said surfaces and to ride into said recesses and out of said recesses in both directions of relative movement between a detent and its associated first recess without damage to the parts, resilient means for urging said detents into said recesses to provide a releasable driving connection between said legs, interengageable stop means on said arm mounting means and on said flanges for limiting the movement of said legs under the action of said connection to limit positions, each of said surfaces being provided with a second recess spaced from said first recess at a location beyond one of the limit positions of the associated leg and corresponding to a sitting position of the leg, each leg adapted to be moved against the action of said resilient means with the associated stop means in engagement out of the corresponding first recess and along said surface and into engagement with the corresponding second recess.

12. Apparatus as in claim 11 in which said resilient means comprises inherently resilient portions of said arms.

13. Apparatus as in claim 11 in which said arm mounting means comprises means mounting said arms for pivotal movement around said arm axis and for rocking movement around axes perpendicular to said arm axis and in which said resilient means comprises a spring for urging said arms in the direction of said axis.

14. Apparatus as in claim 11 in which each of said surfaces is symmetrical with the corresponding leg axis throughout the extent of the surface outside its recesses.

* * * * *